US005934670A

United States Patent [19]

Todoki

[11] Patent Number: 5,934,670

[45] Date of Patent: Aug. 10, 1999

[54] APPARATUS HAVING A ROTARY CIRCULATING MECHANISM

[75] Inventor: Kenji Todoki, Wakayama, Japan

[73] Assignee: Noritsu Koki Co., Ltd., Wakayama-ken, Japan

[21] Appl. No.: 08/738,315

[22] Filed: Oct. 25, 1996

[30] Foreign Application Priority Data

| | | | |
|---|---|---|---|
| Oct. 25, 1995 | [JP] | Japan | 7-277797 |
| Oct. 25, 1995 | [JP] | Japan | 7-277798 |
| Oct. 15, 1996 | [JP] | Japan | 8-272035 |
| Oct. 15, 1996 | [JP] | Japan | 8-272036 |

[51] Int. Cl.[6] ..... B65H 39/10; B65G 15/44; B65G 17/32

[52] U.S. Cl. ..... 271/294; 271/292; 271/903; 198/697; 198/680; 198/801

[58] Field of Search ..... 271/292, 294, 271/903; 198/697, 680, 801

[56] References Cited

U.S. PATENT DOCUMENTS

| | | | |
|---|---|---|---|
| 465,572 | 12/1891 | Diebold | 198/801 |
| 899,854 | 9/1908 | Younkman | 198/801 |
| 3,012,653 | 12/1961 | Schramm | 198/801 |
| 3,245,518 | 4/1966 | Reibel et al. | 198/801 |
| 4,274,624 | 6/1981 | Sato et al. | 271/292 |
| 4,358,009 | 11/1982 | Rysti | 198/680 |
| 4,730,721 | 3/1988 | Demaiter et al. | 198/801 |

FOREIGN PATENT DOCUMENTS

| | | |
|---|---|---|
| 0068462 | 6/1982 | European Pat. Off. . |
| 0359727 | 8/1989 | European Pat. Off. . |

*Primary Examiner*—William E. Terrell
*Assistant Examiner*—Joe Dillon, Jr.
*Attorney, Agent, or Firm*—Fulbright & Jaworski, LLP

[57] ABSTRACT

A sorter includes a plurality of receiver members for receiving a workpiece, and a rotary circulating mechanism driven by a driving unit to circulate along a circulatory path. The circulating mechanism mounts the receiver members to be pivotable about a first pivot axis. On the circulatory path of the rotary circulating mechanism, each receiver member is switchable between an extended posture at which the receiver member is capable of receiving the workpiece and a folded posture at which the receiver member is pivotally folded about the first axis to the vicinity of the rotary circulating mechanism. Each receiver member has at least one second pivot axis extending substantially parallel to the first pivot axis. Also, each receiver member includes a plurality of receiver elements which are pivotable relative to each other about the second pivot axis and an extended-posture maintaining mechanism interposed between the adjacent receiver elements for maintaining the receiver elements at a predetermined posture when the receiver member assumes the extended posture.

13 Claims, 13 Drawing Sheets

APPARATUS HAVING A ROTARY CIRCULATING MECHANISM

BACKGROUND OF THE INVENTION

1. Field of the Invention

The present invention relates to a sorter including a plurality of receiver members for receiving a workpiece, a rotary circulating mechanism (e.g. an endless chain) driven by a driving means to circulate along a circulatory path, and a plurality of receiver member support shafts attached to the rotary circulating mechanism for pivotally supporting the receiver members, in which on the circulatory path of the rotary circulating mechanism, each receiver member is switchable between an extended posture at which the receiver member is capable of receiving the workpiece and a folded posture at which the receiver member is pivotally folded about the support shaft to the vicinity of the rotary circulating mechanism.

2. Description of the Related Art

In the case of a conventional sorter of the above-noted type, each receiver member is constructed from a single sheet of plate member.

However, if each receiver member is constructed from a single sheet of plate member as described above, there is a limit in reducing the space to be occupied by the plurality of receiver members.

Accordingly, in a sorter of the above noted type having a plurality of circulating receiver members, a primary object of the present invention is to provide an improved sorter which can minimize the space occupied by the receiver members when assuming the folded posture.

SUMMARY OF THE INVENTION

For accomplishing the above-noted object, according to the present invention, a sorter comprises:

a plurality of receiver members for receiving a workpiece;

a rotary circulating mechanism driven by a driving means to circulate along a circulatory path, the circulating mechanism mounting the receiver members to be pivotable about a first pivot axis;

wherein, on the circulatory path of the rotary circulating mechanism, said each receiver member is switchable between an extended posture at which the receiver member is capable of receiving the workpiece and a folded posture at which the receiver member is pivotally folded about the first axis to the vicinity of the rotary circulating mechanism;

said each receiver member has at least one second pivot axis extending substantially parallel to the first pivot axis and said each receiver member includes a plurality of receiver elements which are pivotable relative to each other about said second pivot axis and an extended-posture maintaining mechanism interposed between the adjacent receiver elements for maintaining the receiver elements at a predetermined posture when said receiver member assumes the extended posture.

With the sorter having the above-described construction, the sorter, more particularly the rotary circulating mechanism, is driven to circulate along a circulatory path. And, at differing portions on this circulatory path, the receiver member(s) carried by the circulating mechanism selectively assumes either the extended posture or the folded posture. Then, in the case of the receiving member according to the sprit of the present invention, in the folded posture, each receiver member is pivotally folded about the first pivot axis and in addition the respective receiver elements thereof are pivotally folded about the second pivot axis. Accordingly, if this receiver member is constructed from two receiver elements for example, the receiver member may be folded two times thereby to occupy less space in the circulatory path. Therefore, the space needed for allowing the circulating movement of these receiver members may be advantageously reduced, whereby the entire apparatus may be formed compact.

Namely, according to one aspect of the present invention, the receiver member includes a base-end receiver element disposed adjacent the first pivot axis and a distal-end receiver element pivotable relative to the base-end receiver element about the second pivot axis.

In the case of the above construction, it is possible to construct the receiver member from one pair of receiver elements which are pivotable connected to each other via the single second pivot axis. And, of the two receiver elements, the base-end receiver element is pivotably supported by the support shaft of the receiver member. Accordingly, this provides the simplest construction for the receiver member, whereby the space occupied by the folded receiver member may be minimized.

According to a further aspect of the present invention, the circulatory path of the receiver members includes a vertical path portion, the first pivot axis comprises a horizontal axis, and at the extended posture, the receiver member extends obliquely upward relative to the horizontal first pivot axis.

With the above construction, the receiver member is pivoted about the horizontal first pivot axis and is maintained at the obliquely upward extended posture for receiving the workpiece. Thus, this construction allows the receiver member to receive the workpiece which is gravity-fed from above. Hence, the sorting operation may be assisted by the gravity. Furthermore, the gravity may assist also the switchover operation of the receiver member from the folded posture to the extended posture. In the respect, if this switchover operation of the receiver member depends solely on the effect of the gravity, the operation tends to take place in a rather uncontrolled manner accompanied by e.g. a shock. Then, by interposing resistance means between the components which are moved relative to each other for the switchover operation, even if a sudden movement such as excessive acceleration may occur in the course of the switchover operation, it becomes possible to absorb its shock, thereby assuring stable operation.

According to a still further aspect of the present invention, a sorter frame having the drive means includes a posture setting cam for setting the posture of the receiver member whereas the receiver member includes a cam contact portion capable of coming into contact with the posture setting cam, the cam contact portion coming into contact with the posture setting cam immediately before the vertical path portion so as to bring the gravity center of the receiver member to a side opposite to the rotary circulating mechanism relative to the first pivot axis.

According to the above-described construction, the receiver member comes to an upper portion of the vertical path portion with its cam contact portion being kept in contact with the posture setting cam. And, through this contact, the center of gravity of the receiver member is brought to the opposite side to the circulating mechanism relative to the first pivot axis. Accordingly, the receiver member is gravity-urged pivotably by its own mass from the folded posture toward the extended posture, so that the member may be automatically switched over to the latter posture.

This construction assures reliable switchover of the posture by a relatively simple arrangement through appropriate selection of the cam shape, and its position and may stabilize the posture as well.

According to a still further aspect of the invention, the extended-posture maintaining mechanism is capable of maintaining the receiver elements at either a straight posture or a bent posture.

Various modifications are conceivable concerning at what specific predetermined posture the receiver elements are to be maintained. Especially, if the elements are maintained at a bent posture where the elements are bent relative to each other, this is advantageous for preventing the leading end of the receiver member from sagging when the member receives a significant load of workpiece.

Further and other objects, features and effects of the invention will become more apparent from the following more detailed description of the embodiments of the invention with reference to the accompanying drawings.

DETAILED DESCRIPTION OF THE PREFERRED EMBODIMENTS

Preferred embodiments of the present invention will be described in details with reference to the accompanying drawings.

Figure 1:
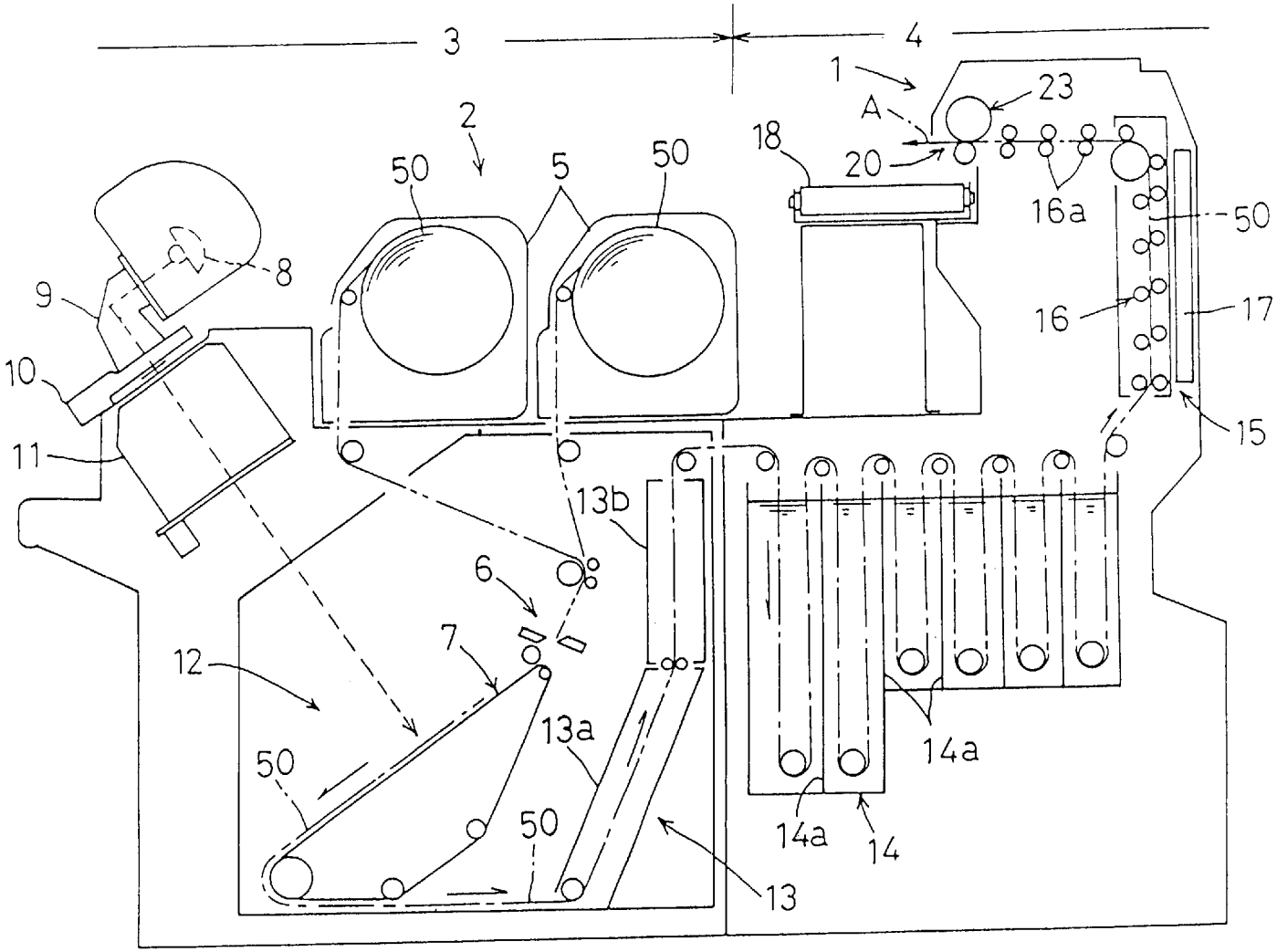
FIG. 1 is a schematic construction view of a photographic printing-developing system incorporating a sorter relating to the present invention.

FIG. 1 is a schematic overall construction view of a photographic printing-developing system 2 incorporating a photosensitive material arraying apparatus 1. In the figure, numeral 3 denotes a printing-exposing section and numeral 4 denotes a developing section. The construction of the printing-exposing section 3 is conventional. Therefore, only the names of its components will be recited. Numeral 5 denotes magazines each storing therein photosensitive material 50 in a rolled state. Numeral 6 denotes a cutter. Numeral 7 denotes a suction belt for transporting the material. Numeral 8 denotes a light source. Numeral 9 denotes a mirror tunnel. Numeral 10 denotes a negative mask. And, numeral 11 denotes a lens unit.

The printed and exposed photosensitive materials 50 are serially transported on a conveyer 12 along the direction of arrows to a juxtaposing device 13. This juxtaposing device 13 functions to juxtapose the serially transported materials 50 into a three-lane, phase-staggered formation and then to forward the materials downstream under this condition. For providing these functions, the juxtaposing device 13 includes a juxtaposing unit 13*a* for juxtaposing the photosensitive materials 50 and a conveyer 13*b* for forwarding the juxtaposed photosensitive materials 50 in the transporting direction. Accordingly, by the function of this juxtaposing device 13, the photosensitive materials 50 are arranged into the three-lane, phase-staggered formation having phase differences in the transporting direction (i.e. the direction denoted by the arrows in the figure). For this reason, the juxtaposing unit 13*a* described above includes a movable table (not shown) for shifting the coming photosensitive materials 50 relative to each other in the direction normal to the transporting direction.

Downstream of the juxtaposing device 13, the developing section 4 is disposed.

This developing section 4 includes, along the transporting direction of the photosensitive materials, a developing tank 14 for holding processing liquids therein, a drying section 15, and the photosensitive material arraying apparatus 1.

The inside of the developing tank 14 is divided by means of partition plates 14*a* into a plurality of sections which respectively hold therein a plurality of kinds of processing liquid needed for the developing operation. As shown, the transport passage of the photosensitive materials 50 extends through the respective sections, so that the materials 50 may be caused to pass these sections one after another.

The drying section 15 includes a plurality of transporting pinch roller mechanisms 16 (each mechanism is comprised of a pair of mutually contacting rollers) disposed along the transporting direction and a heater 17 disposed beside the transport passage for drying the materials 50 while being caused to pass this section 15.

Thereafter, the dried photosensitive materials 50 are introduced into the photosensitive material arraying apparatus 1.

Referring to a transporting system in this photosensitive material arraying device 1, the system includes a transport passage for receiving the developed and dried photosensitive materials 50 and forwarding them toward a transport conveyer 18, and a photosensitive material receiving mechanism 19 for receiving the materials in the unit of e.g. one film roll amount.

Figure 2:
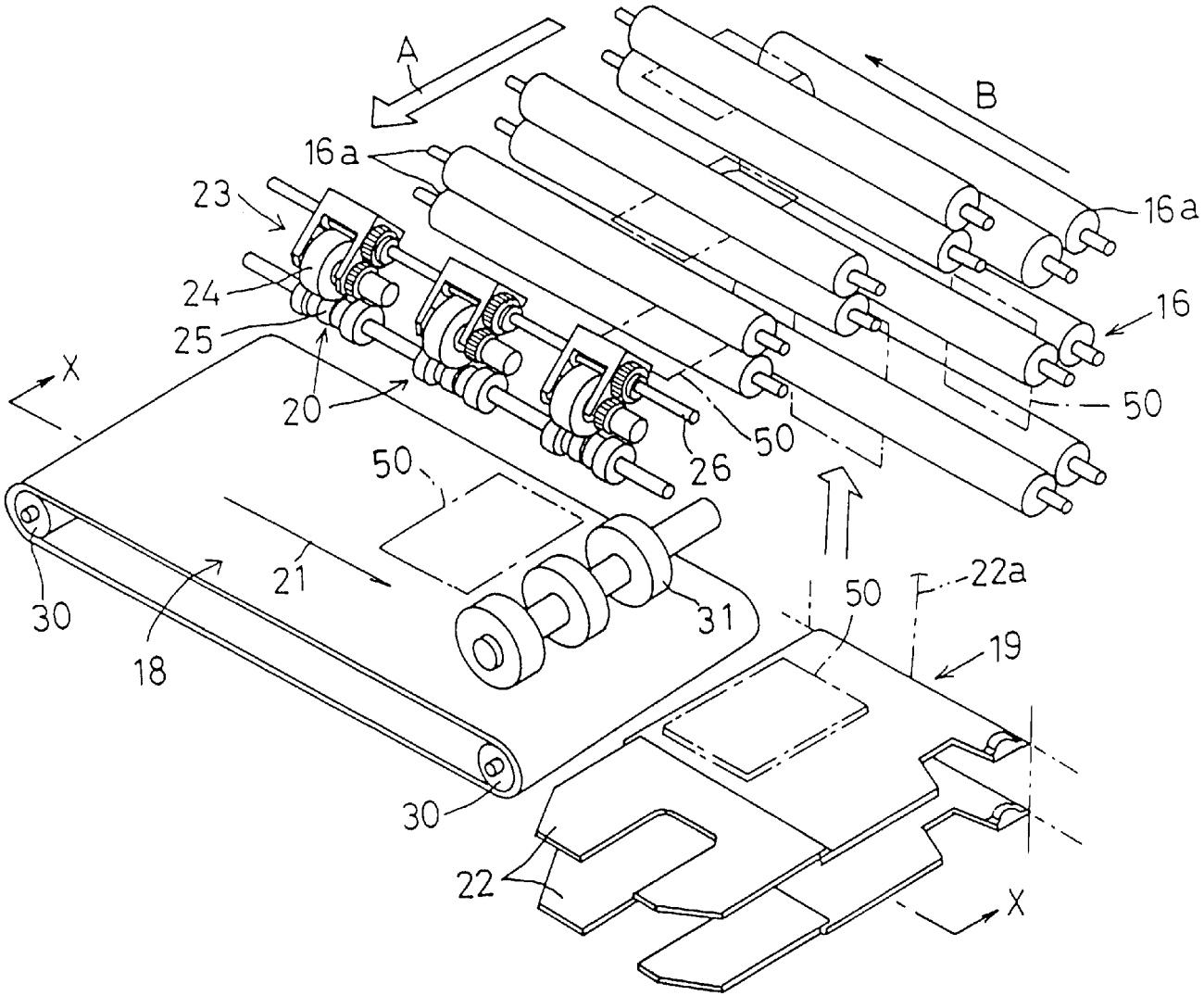
FIG. 2 is a perspective view showing the construction of the system around a transport conveyer.

More particularly, the transport conveyer 18, as shown in FIG. 2, is disposed between an exit 20 of the transport passage in this arraying apparatus and the photosensitive material receiving mechanism 19. And, this conveyer 18 includes a conveying passage 21 extending substantially normal to a discharging direction A of the materials 50 discharged from the exit 20. Accordingly, this transport conveyer 18 receives the photosensitive materials 50 transported in the three-lane, phase-staggered formation at positions differing in the moving direction of the conveyer and conveys these materials 50 onto receiver plates 22 of the photosensitive material receiving mechanism 19.

Next, the construction of the arraying apparatus adjacent the exit 20 of the transport passage will be described in details.

As described hereinbefore, along the transport passage of the photosensitive materials 50, there are provided the plurality of transporting pinch roller mechanisms 16 each of which is comprised of a pair of pinch rollers 16*a* as described hereinbefore. Further, at the last stage position of the transport passage, there is disposed a discharging pinch roller mechanism 23 having a higher film transporting speed than the transporting pinch roller mechanisms 16.

As shown in FIG. 2, in the juxtaposing direction B (i.e. the direction along the length of the transport conveyer 18) of the photosensitive materials 50, only one roller pair 16*a*, i.e. one transporting pinch roller mechanism 16, is provided.

Figure 3:
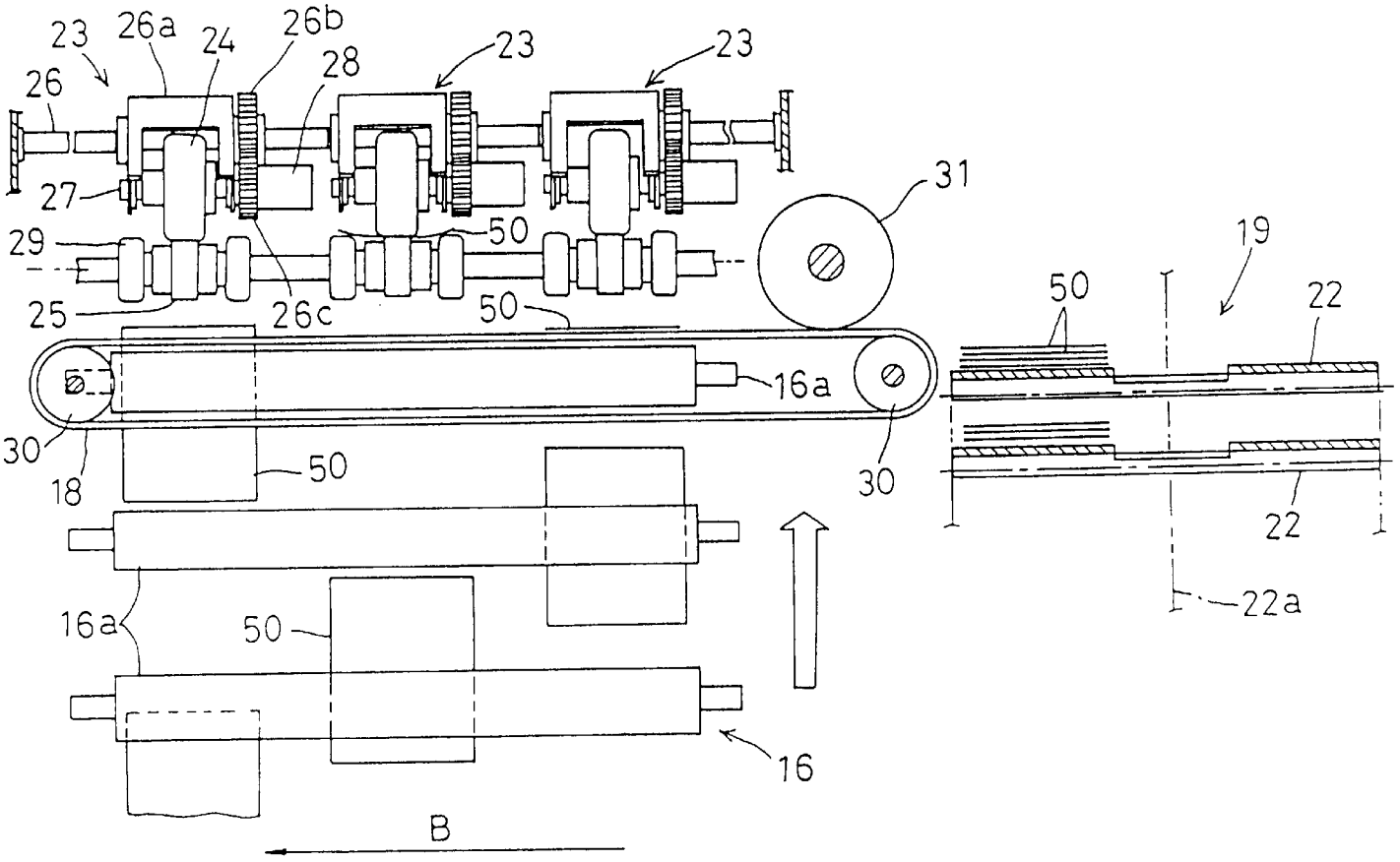
FIG. 3 is a section view taken along a line X—X in FIG. 2.

As shown in FIG. 3, the discharging pinch roller mechanism 23 includes large drive rollers 24 and small driven roller 25 contactable with the respective drive rollers 24 to be rotatable in unison therewith. The drive rollers 24 are mounted on respective roller shafts 27 supported to frames 26*a* which in turn are supported on a common drive shaft 26. Between the drive shaft 26 and each roller shaft 27, there is interposed a gear drive transmission mechanism 26*b*. Further, between a driven gear 26*c* of the gear drive transmission mechanism 26*b* and the roller shaft 27 of the drive roller 24, there is interposed a torque limiter 28 for rendering the roller 24 freely rotatable in response to a torque greater than a predetermined value. In this instant embodiment, this torque limiter 28 is the so-called magnet particle type. However, any other type of torque limiter may be employed instead.

Further, coaxially with the drive roller 25, there are disposed guide rollers 29 across the driven roller 25. And, these guide rollers 29 have a greater diameter than the driven roller 25.

As shown in FIG. 2, on the outer side of the exit 20 of the transport passage, the transport conveyer 18 is provided as described hereinbefore. This transport conveyer 18 may be driven in an intermittent manner in association with discharging operation of the photosensitive material 50. This intermittent drive of the transport conveyer 18 is effected by a drive unit (not shown) operatively connected with a pulley 30 of the conveyer. Numeral 31 denotes a press roller.

Downstream of the transport conveyer 18, there is provided a sorter 19 which includes a plurality of stages of receiver plates 22 for receiving the photosensitive materials 50 aligned with each other. These receiver plates 22 are mounted on a vertically movable endless chain 22*a*, so that each plate 22 may be moved to a horizontal position level and joining with the transport conveyer 18. In operation, when the photosensitive materials 50 corresponding to frames of one roll of film are stacked onto one receiving plate 22, this plate 22 is moved downward to bring the next upper receiving plate 22 to the horizontal level position for receiving further photosensitive materials 50 to be forwarded from the transport conveyer 18.

Figure 4:
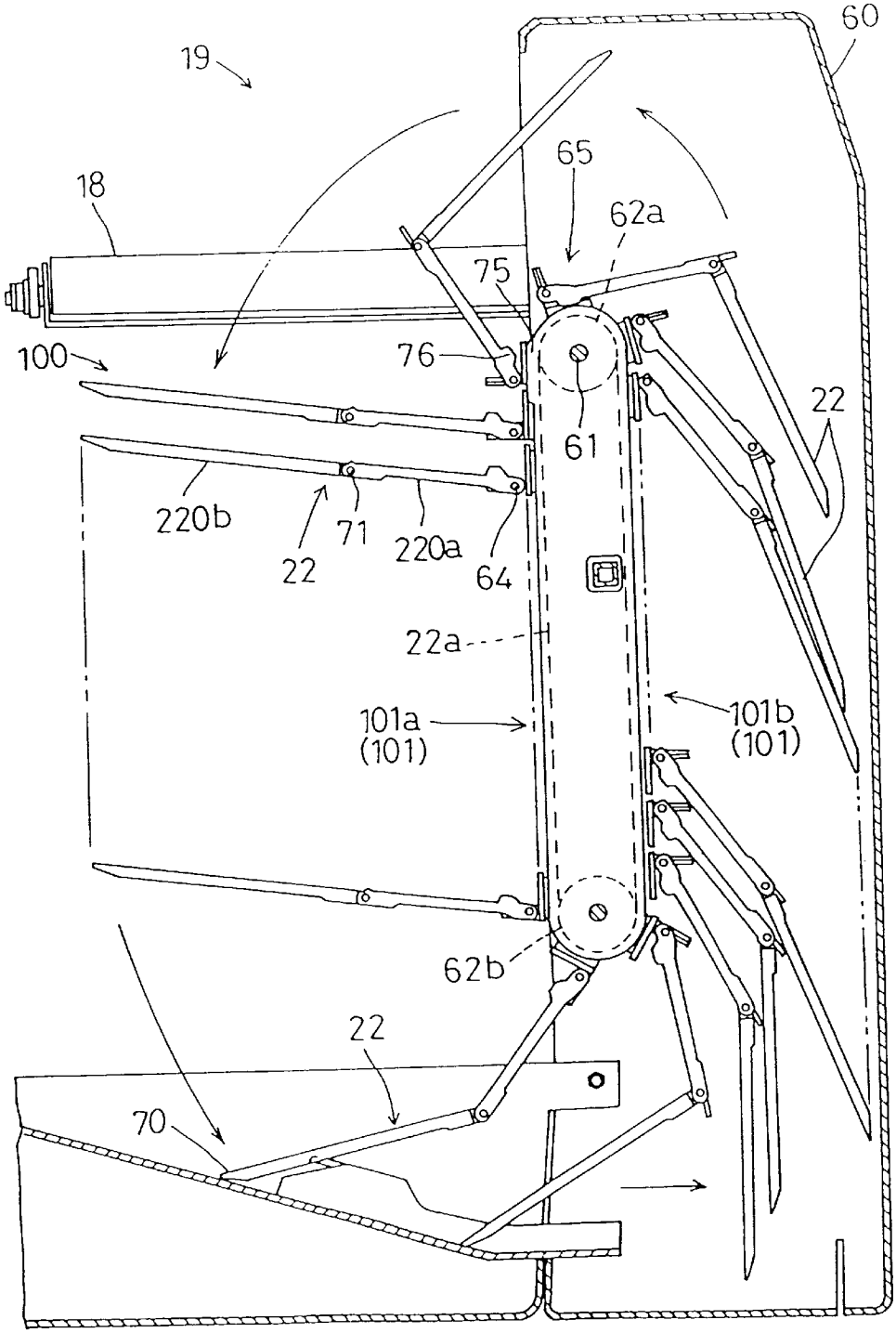
FIG. 4 is a horizontal section of the sorter.
Figure 5:
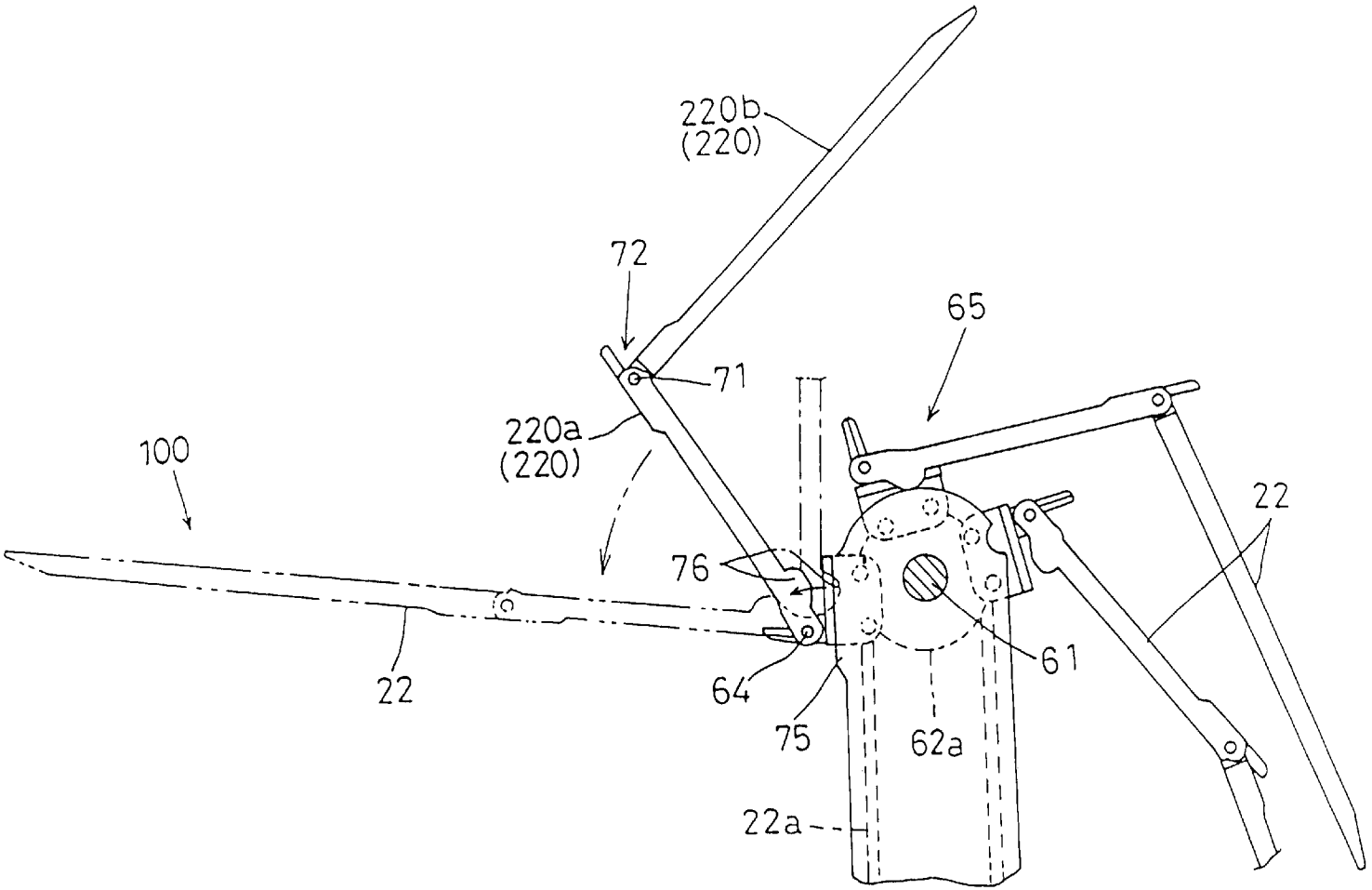
FIG. 5 is a detailed view of a top portion of the sorter.
Figure 6:
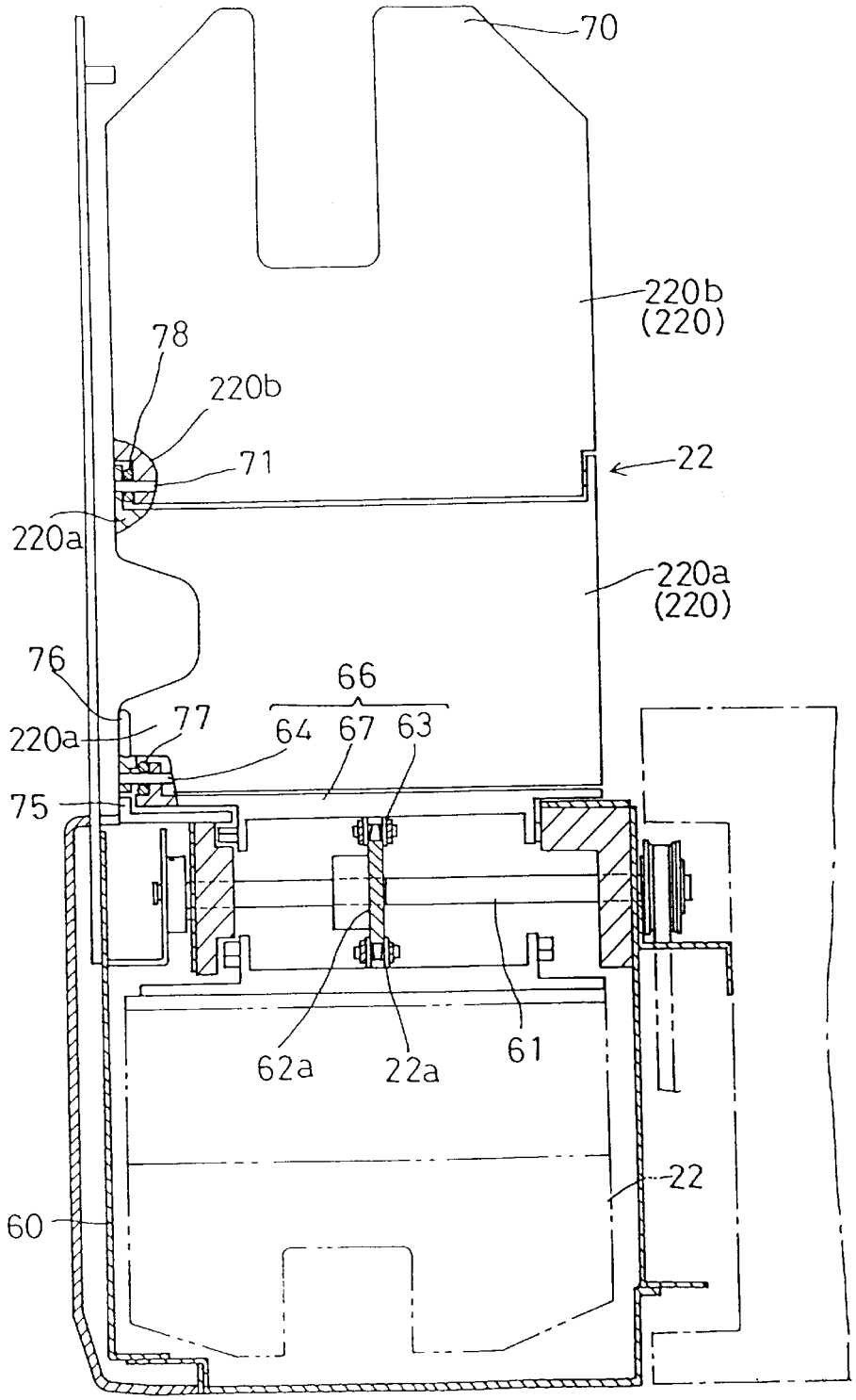
FIG. 6 is a plan view of receiver plates attached to the sorter.
Figure 7:
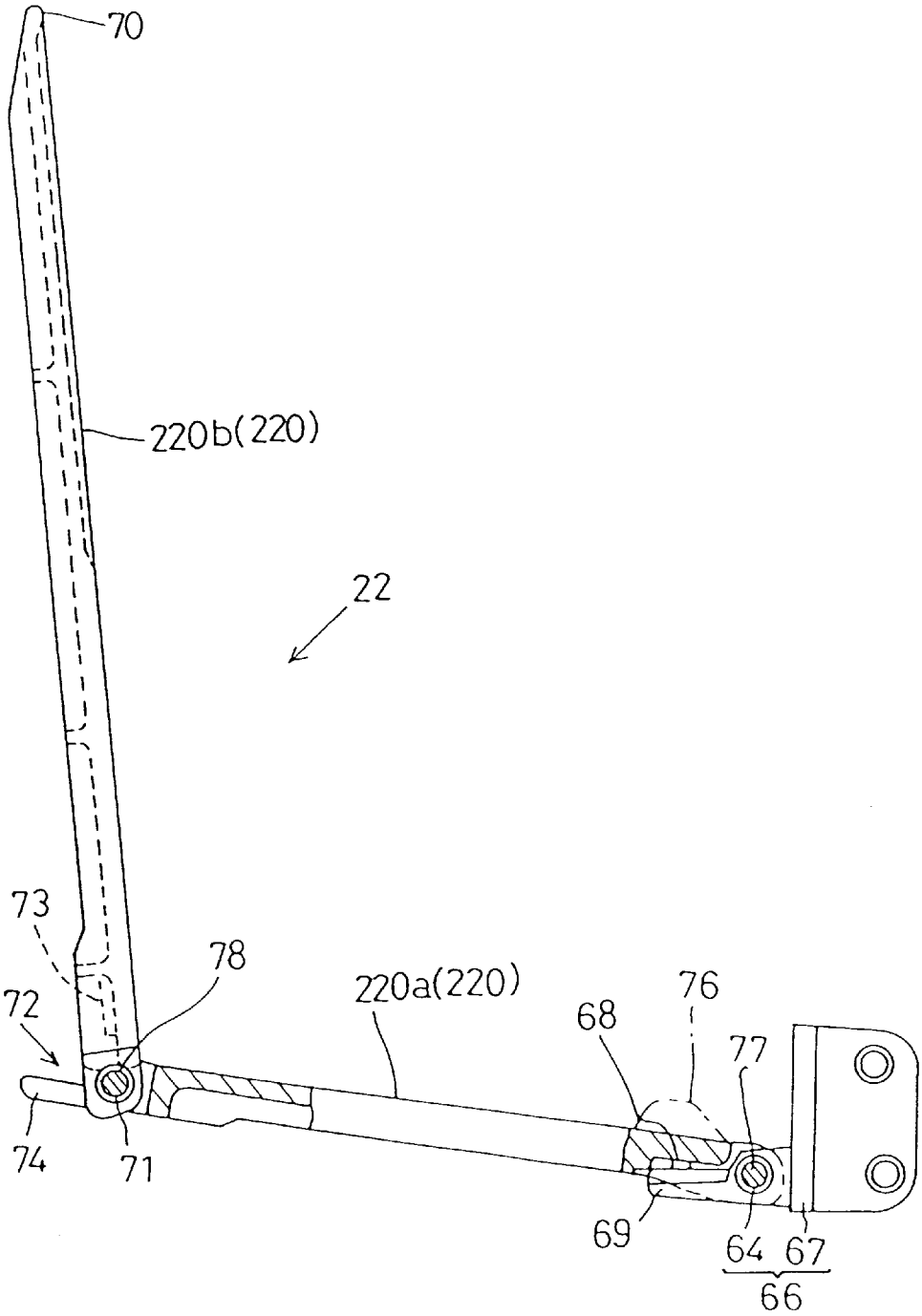
FIG. 7 is a side view of the receiver plate.

Next, the detailed construction of the sorter 19 will be described. FIG. 4 is a horizontal section of the sorter 19; FIG. 5 is a detailed view of a top portion of the sorter 19; FIG. 6 is a plan view showing the receiver plates 22 and their periphery; and FIG. 7 is a side view of one receiver plate 22, respectively.

This sorter 19 includes a chain drive sprocket 62*a* mounted on a drive shaft 61 which in turn is driven to rotate by a drive mechanism (not shown) relative to a sorter frame 60 and a driven sprocket 62*b* paired with the drive sprocket 62*a*. Accordingly, as shown, the chain 22*a* effects a rotary circulating movement. Further, as the sprockets 62*a* and 62*b* are disposed vertically, the circulatory path of the receiver plates 22 includes vertical path portions 101 (101*a*, 101*b*).

Next, the attaching construction between the chain 22*a* and each receiver plate 22 for receiving the photosensitive materials 50 as 'workpieces' will be described. As shown in FIG. 6, a link 63 is attached to the chain 22*a* and the link 63 integrally includes a link attachment 67 which mounts a receiver-plate support shaft 64. This receiver-plate support shaft 64 pivotally mounts the receiver plate 22. The receiver-plate support shaft 64 provides a horizontal first pivot axis. Further, the receiver-plate support shaft 64, the link 63 and the link attachment 67 provided integrally with the link 63 together constitute a receiver-plate support portion 66.

With this sorter 19 of the present invention, on the circulatory path of the chain 22*a*, each receiver plate 22 is switchable between an extended posture where the plate 22 is capable of receiving the workpieces (i.e. the posture assumed by the receiver plates 22 on the left-side vertical path portion 101*a* in FIG. 4) and a folded posture where the receiver plate 22 is pivotally folded about the receiver-plate support shaft 64 to the vicinity of the chain 22*a* (i.e. the posture assumed by the receiver plates 22*a* on the right-side vertical path portion 101*b* in FIG. 4).

Referring more particularly to the extended posture mentioned above, in order to assume this posture, the receiver plate 22 is moved beyond a top 66 of the circulatory path by a predetermined distance. Then, the receiver plate 22 extends straight obliquely upward from the receiver-plate support portion 66 provided at the base end of this receiver plate 22. This is the extended posture. The support of the plate 22 at this posture from the under side is provided by contact between a first contacting portion 68 provided at the base end of the receiver plate 22 and a first contacted portion 69 provided to the link attachment 67 (see FIG. 7).

The folded postured of the receiver plate 22 is realized by contact between a distal end 70 of this plate 22 and the sorter frame 60 and the support of the plate 22 at this folded posture is provided by contact with the next receiver plate 22.

Next, the construction of the receiver plate 22 to which the present invention particularly relates will be described.

As shown in FIGS. 6 and 7, the receiver plate 22 includes a pivot shaft 71 ('second pivotal axis') extending substantially parallel with the receiver-plate support shaft 64 described hereinbefore as the horizontal first axis and a plurality of receiver elements 220 pivotable about the pivot shaft 71. Further, between the receiver elements 220, there is interposed an extended-posture maintaining mechanism 72 for maintaining the receiver elements 220 along a straight posture extending away from the receiver-plate support shaft 64 when the receiver plate 22 assumes the extended posture.

More specifically, in the instant embodiment, the receiver plate 22 has the simplest construction provided by the invention of a double-foldable construction. That is, this receiver plate 22 includes a base-end receiver element 220*a* provided adjacent the receiver-plate support shaft 64 and a distal-end receiver element 220*b* which is pivotably supported to the base-end receiver element 220*a* via the pivot shaft 71. Accordingly, the entire receiver plate 22 per se may be folded at an intermediate position thereof. Then, on the right-side vertical path portion 101*b* in FIG. 4 (the receiver plates 22 are moved upward at this path portion), the distance between the chain and the sorter frame 60 may be shorter than that of the conventional construction, without entailing any inconvenience.

Further, between the distal-end receiver element 220*b* and the base-end receiver element 220*a*, there are provided a second contacting portion 73 and a second contacted portion 74 in correspondence respectively with the first contacting portion 68 and the first contacted portion 69 described hereinbefore. The second contacting portion 73 and the second contacted portion 74 together constitute an extended-posture maintaining mechanism 72. Then, by contact provided by this extended-posture maintaining mechanism 72, under the extended posture, the receiver plate 22 (i.e. the receiver elements) may be maintained under the straight posture.

The present invention provides further features for smoothing the movement of the receiver plate 22 past the top 65 of the circulatory path to assume the extended posture. These features will be described next.

Namely, for realizing the above-noted object, as shown in FIGS. 4 and 5, the sorter frame 60 includes a receiver plate posture setting cam 75, whereas, the receiver plate 22 includes a cam contact portion 76 contactable with the receiver plate posture setting cam 75. As the receiver plate posture setting cam 75 and the cam contact portion 76 come into contact with each other at a position immediately before the vertical path portion so as to bring the gravity center of the receiver plate 22 to a side opposite to the chain 22*a* relative to the receiver plate support shaft 64. With this construction, adjacent the entrance denoted with a numeral 100 in FIG. 4 to the left-side vertical path portion 101*a*, the receiver plate posture setting cam 75 and the cam contact portion 76 come into contact with each other, whereby the receiver plate 22 is caused to be pivoted by the gravity from its own mass about the receiver plate support shaft 64. Accordingly, the above-described switchover operation of the receiver plate to the extended posture may be effected smoothly and speedily.

With the sorter 19 having the above construction, the switchover operation of the receiver plate 22 from the folded posture to the extended posture is effected adjacent the top of the circulatory path and in the vicinity where the receiver plate 22 begins to move downwards. In the course of this, if the pivotal movement takes place in a violent and sudden manner between the receiver plate support shaft 64 and the receiver plate 22 and also between the pivot shaft 71 and the receiver element 220 (i.e. the distal-end receiver element 220*b*) pivotally attached to this shaft 71, the posture switchover operation is let to take place abruptly until the first contact portion 68 and the first contacted portion 69 come into contact with each other and/or the second contact portion 73 and the second contacted portion 74 come into contact with each other, thereby to give a considerable shock to the respective receiver elements 220*a*, 220*b*. And, if this shock is extreme, such problem as rebounding of either the element 220*a* or 220*b* may occur. Accordingly, in order to avoid such phenomenon, the present invention provides an arrangement to be described next.

Specifically, the invention provides resistance means for providing resistance against the momentum of the switchover operation of the receiver plate 22 between the folded posture and the extended posture. More particularly, as shown in FIG. 6, among the receiver plate support shaft 64, the ring attachment 67 and the receiver plate 22, there is provided an O-ring as a first resistance means. Further, between the pivot shaft 71 and the receiver element 220 of the receiver plate 22 (i.e. between the distal-end receiver element 220*b* and the base-end receiver element 220*a*), there is provided a further O-ring 78 as a second resistance means.

Then, when the receiver plate 22 is pivoted about the support shaft 64 to be switched over from the folded posture to the extended posture, the O-rings 77, 78 function to restrict the momentum of the pivotal movement thereby to avoid the phenomenon of rebounding or the like. The resistance of these O-rings 77, 78 should be adjusted in such a manner as to allow the pivotal movement to take place smoothly and speedily, but not so speedily as to cause the rebounding.

In the case of the construction of the present invention, the shock, rebounding or the like is more likely to occur in the receiver plate 22 since this receiver plate 22 is comprised of the two receiver elements 220*a*, 220*b*.

However, by providing the O-rings 77, 78 for giving resistance against the momentum of the switchover pivotal movement, the movement between the respective receiver elements 220*a*, 220*b* as well as between the base-end receiver element 220*a* and the receiver plate support shaft 64 may take place smoothly. Consequently, the movement may take place in a stable and reliable manner.

In short, by providing such resistance means at the respective portions, the receiver plate may be switched over from the folded posture to the extended posture in a shockless and non-rebounding manner.

Next, the operations of the photosensitive material arraying apparatus 1 having the above construction will be described.

In the following description, the photosensitive materials 50 having standard widths ranging e.g. between 89 mm and 6 inches are used as an example.

As described hereinbefore, when the materials 50 are transported to this apparatus 1, these materials 50 are arranged in the three-lane, phase-staggered formation as shown in FIGS. 2 and 3.

In the transport passage, the materials 50 are transported to the passage exit 20 by means of the plurality of transporting pinch roller mechanisms 16 disposed along the transport passage and providing substantially same transporting speed. Then, when the trailing end of this material 50 has left the last transporting pinch roller mechanism 16, the material 50 is accelerated up to the high speed provided by the discharging pinch roller mechanism 23 and discharged at this high speed onto the transport conveyer 18.

Further, as described hereinbefore, at the appropriate opposed positions (i.e. positions at which the photosensitive material 50 may be properly supported in its width direction) across the driven roller 25 of the discharging pinch roller mechanism 23, the guide rollers 29 larger in diameter than the driven roller 25 are provided. Therefore, the photosensitive material 50 is discharged under the curved condition with its opposed edges being slight raised relative to the central portion.

On the transport conveyer 18, the discharged photosensitive materials 50 are conveyed in the direction normal to the discharging direction by the intermittent action of the conveyer 18. In this, for each one of the photosensitive materials 50 transported in the three-lane, phase-staggered formation, the discharging operation and the conveying operation by the conveyer 18 to the receiving plate 22 are repeatedly carried out. In other words, when one photosensitive material 50 is present on the conveyer 18, the next material 50 is maintained at a position where the discharging pinch roller mechanism 23 has not completed its discharging operation. Then, the photosensitive materials 50 discharged one after another in the above-described manner are stacked on the receiving plate 22 by the intermittent action of the transport conveyer 18, so that the photosensitive materials 50 may be re-arranged and stacked according to the order of the frames of the film.

For setting of the timing of intermittent drive of the transport conveyer 18, each trailing end of the photosensitive material 50 discharged at the high speed is detected by means of an optical sensor (not shown), and upon lapse of a predetermined time period after passage of the trailing end, the transport conveyer 18 is driven. Whereas, the movement of the material 50 onto the receiving plate 22 is detected by means of an optical sensor (not shown) and upon this detection the operation of the conveyer 18 is suspended.

Further, based on the signal from the unillustrated optical sensor relating to the detection of the trailing end of the photosensitive material 50, the number of the passed photosensitive materials 50 is counted, and a control circuit (not shown) compares this number with the number of frames of one roll of film. Then, when all sheets of one film roll amount of photosensitive materials 50 have been stacked onto one receiving plate 22, this plate 22 is lowered to bring the next plate to the position for receiving further materials.

This lowering movement of the receiver plate 22 may be effected in the smooth, speedy yet shock-less and non-rebounding manner according to the above-described unique constructions provided by the present invention.

Next, various modified constructions of the receiver plate 22 will be described with reference to FIGS. 8 through 12.

In the first embodiment of FIG. 4, the receiver plate 22 is extended straight in the oblique upward direction. Yet, the present invention is not limited to this particular construction, as will be described next.

Figure 8:
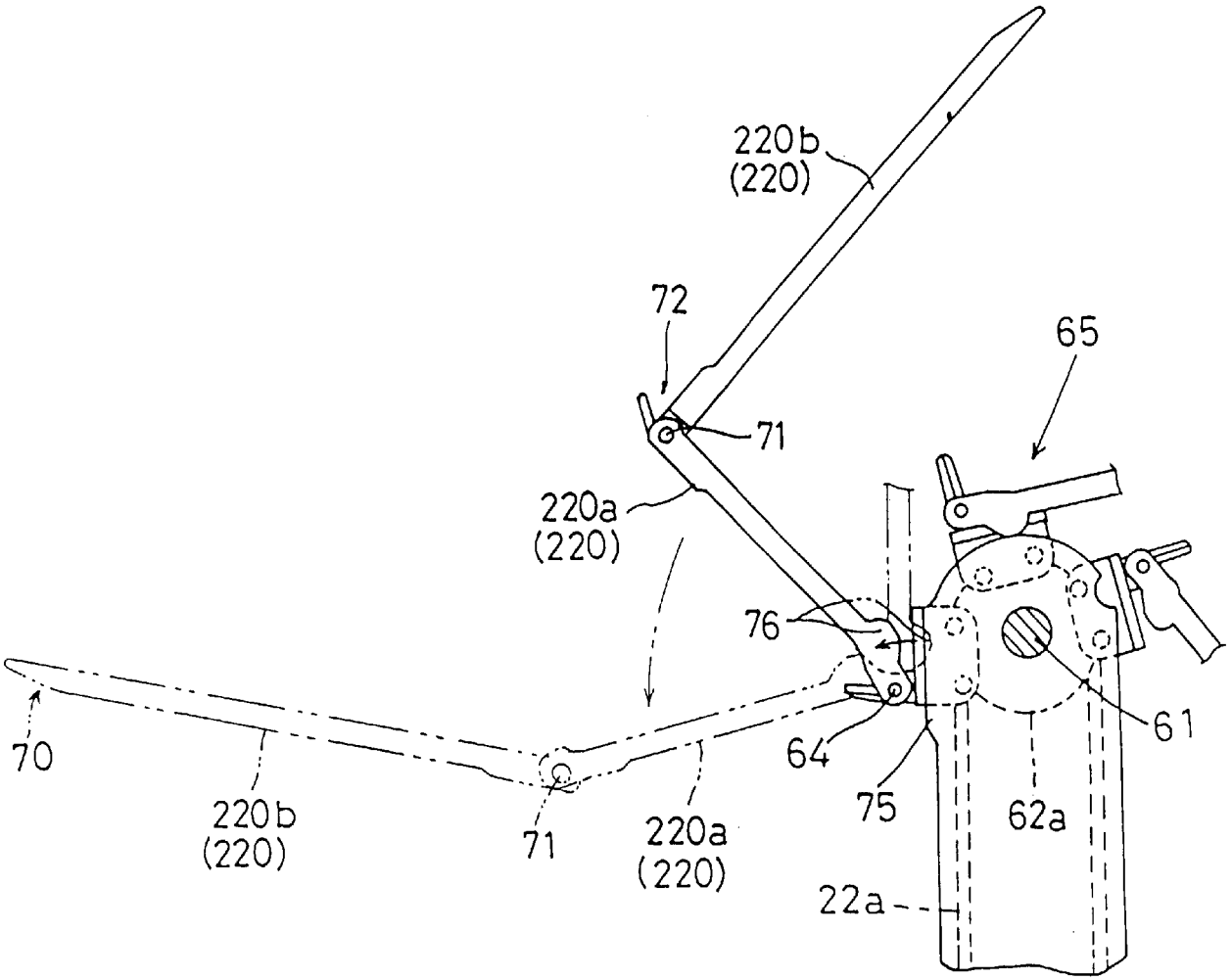
FIG. 8 shows a receiver plate relating to a second embodiment, FIG. 9 also shows the receiver plate relating to the second embodiment.

FIG. 8 shows a modified receiver plate 22 according to a second embodiment of the present invention. In this case, the base-end receiver element 220*a* and the distal-end receiver plate 220*b* are maintained at the respective folded postures thereof. The base-end receiver element 220*a* extends obliquely downward from the receiver plate support shaft 64 and the distal-end receiver element 220*b* extends obliquely upward from the pivot shaft 71, i.e. folded with the receiving face for receiving the photosensitive materials 50 being oriented to the inner side. This construction has the advantage of restricting the leading end 70 of the plate from sagging downward even when the receiver plate 22 receives a large number of photosensitive materials 50.

Figure 9:
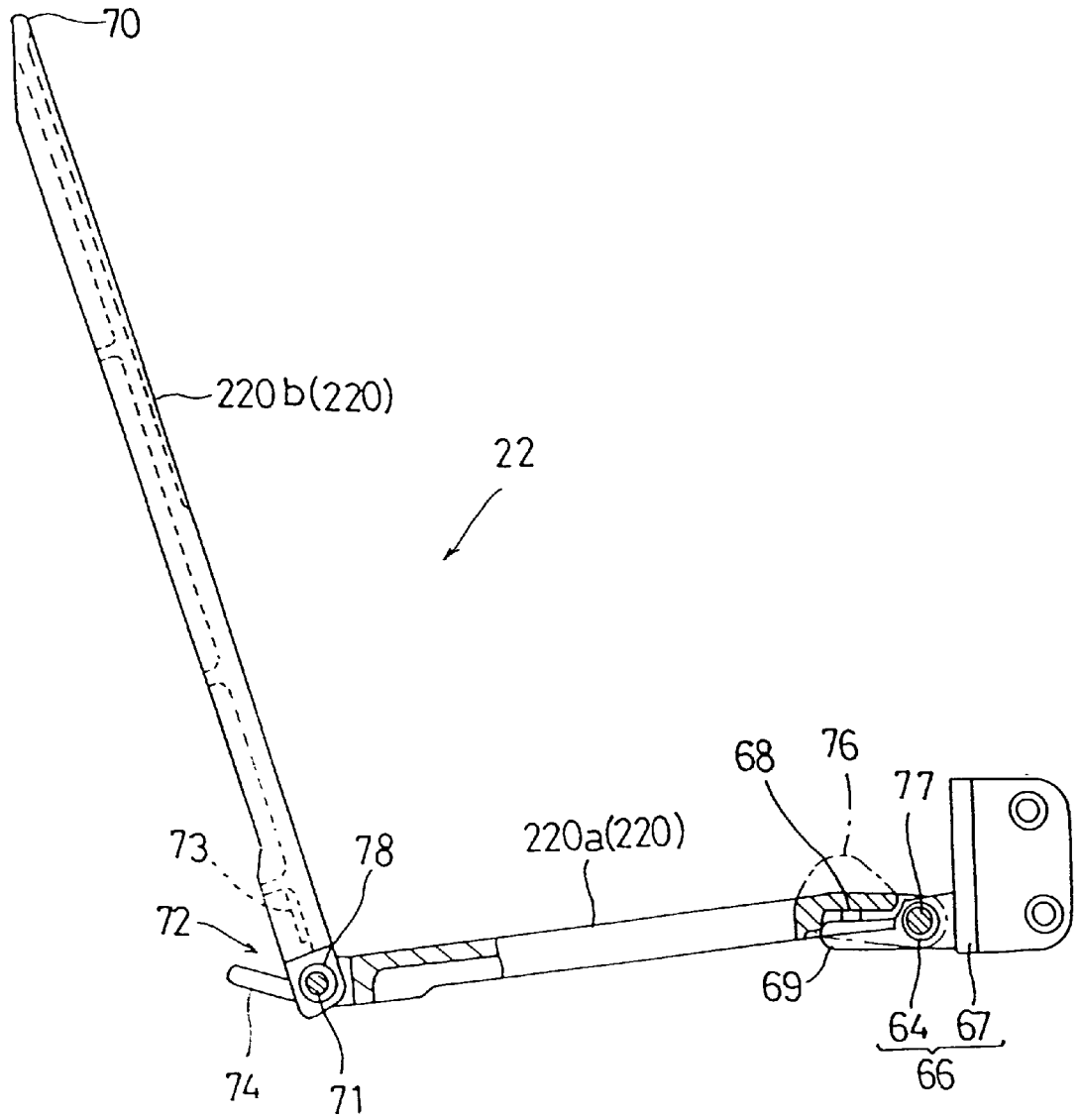

In the case of this construction of FIG. 8, the extended-posture maintaining mechanism 72 will be constructed as shown in FIG. 9. Namely, the extending direction of the distal-end receiver element 220*b* may be varied by varying the inclination of the second contacted portion 74 or the second contact portion 73. Further, the extending direction of the base-end receiver element 220*a* may be varied by varying either the inclination of the first contacted portion 69 or the shape of the first contact portion 68.

Figure 10:
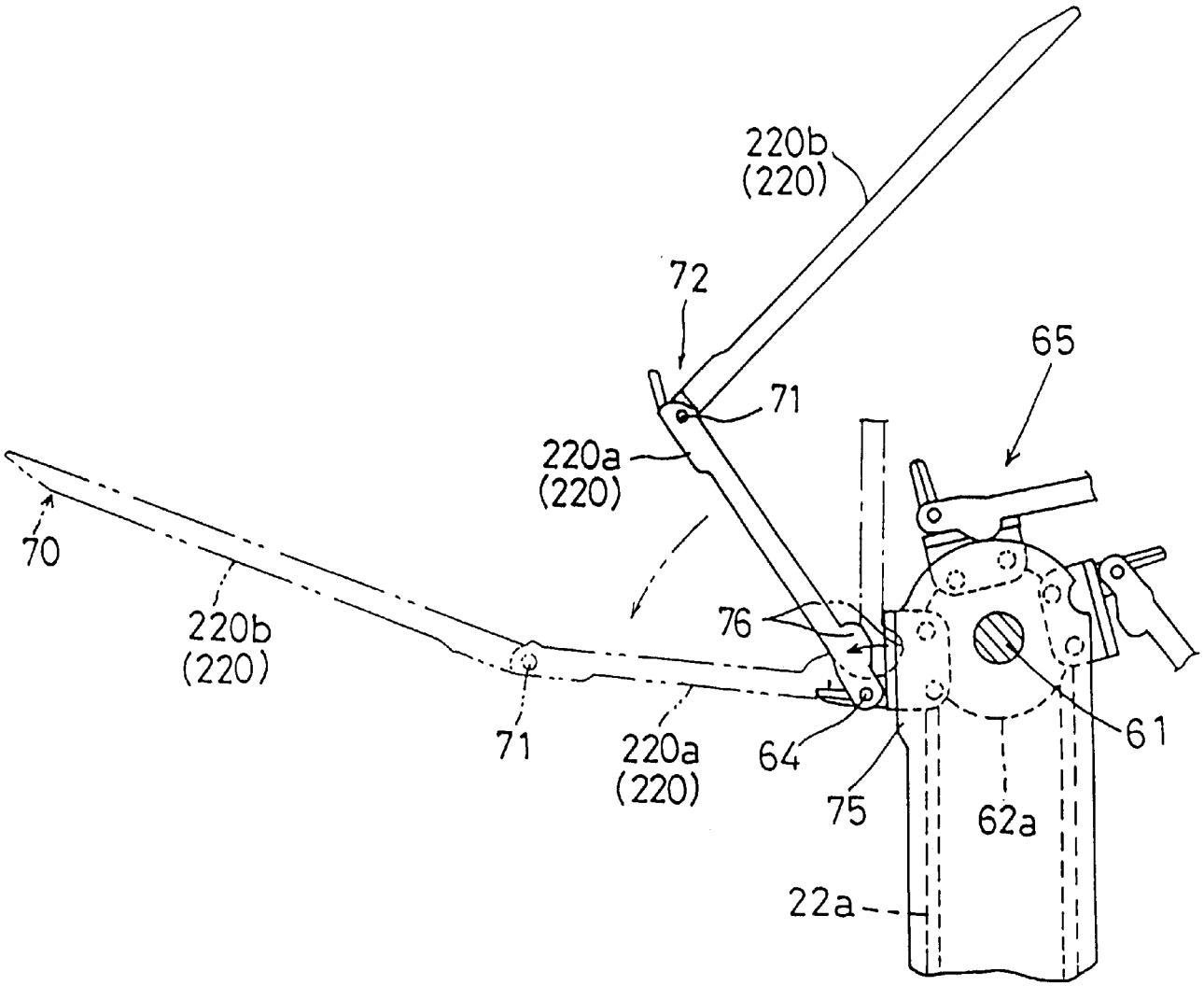
FIG. 10 shows a receiver plate relating to a third embodiment.

FIG. 10 shows a further receiver plate 22 according to a third embodiment of the present invention. In this construction, both the base-end receiver element 220*a* and the distal-end receiver element 220*b* are caused to extend obliquely upward. And, of these two elements 220*a*, 220*b*, the distal-end receiver element 220*b* extends the more upward (with a greater upper inclination), whereby the base-end receiver element 220*a* and the distal-end receiver element 200*b* are maintained at the folded postures.

Figure 11:
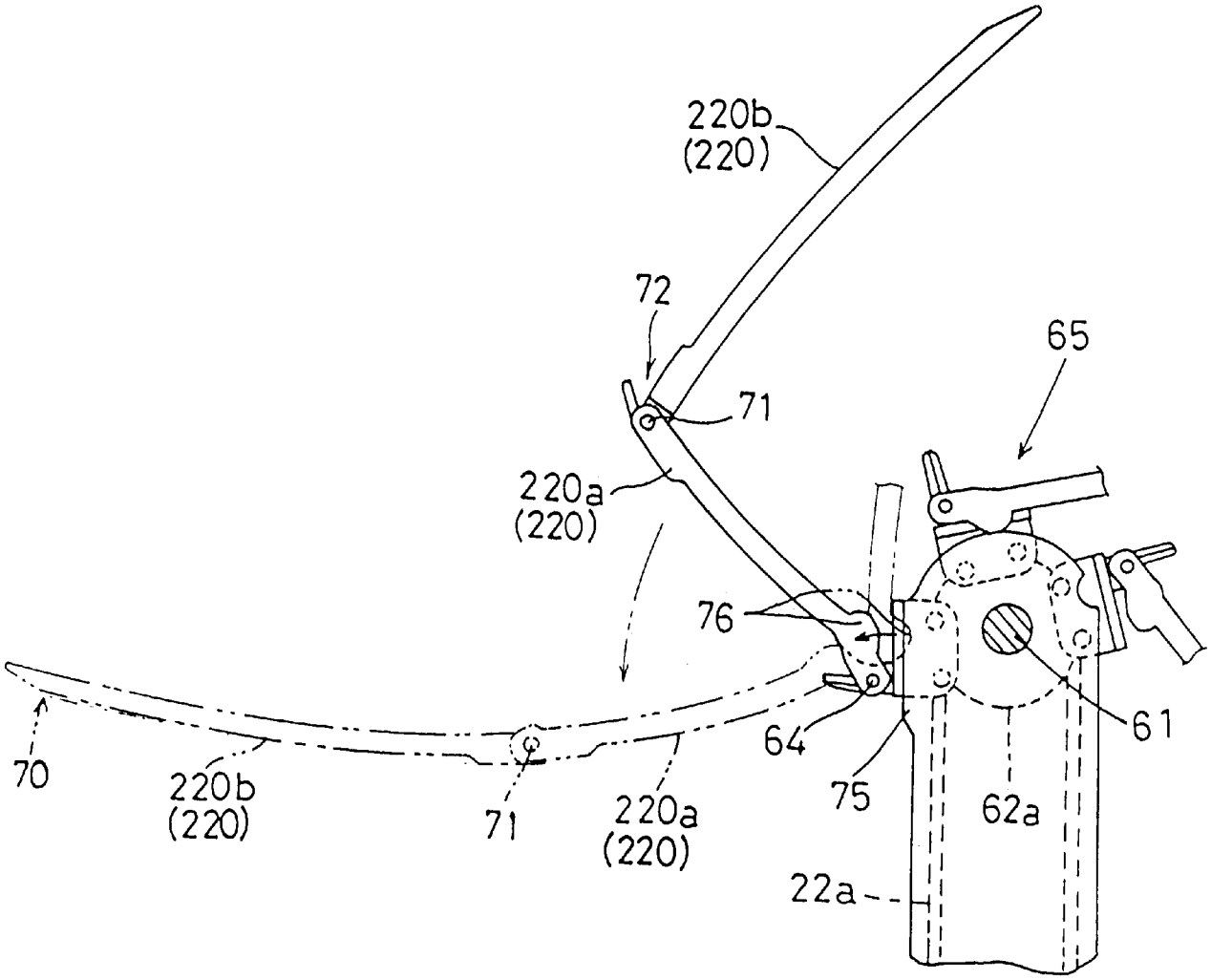
FIG. 11 shows a receiver plate relating to a fourth embodiment.

FIG. 11 shows a still further receiver plate 22 according to a fourth embodiment of the present invention. In this case, the receiver plate 22 has a curved concave receiving face for receiving the photosensitive materials 50. With this construction too, the same effect as achieved by the second and third embodiments may be achieved. The specific curvature of the concave face may be appropriately set depending on the extension length of the receiver plate 22.

Figure 12:
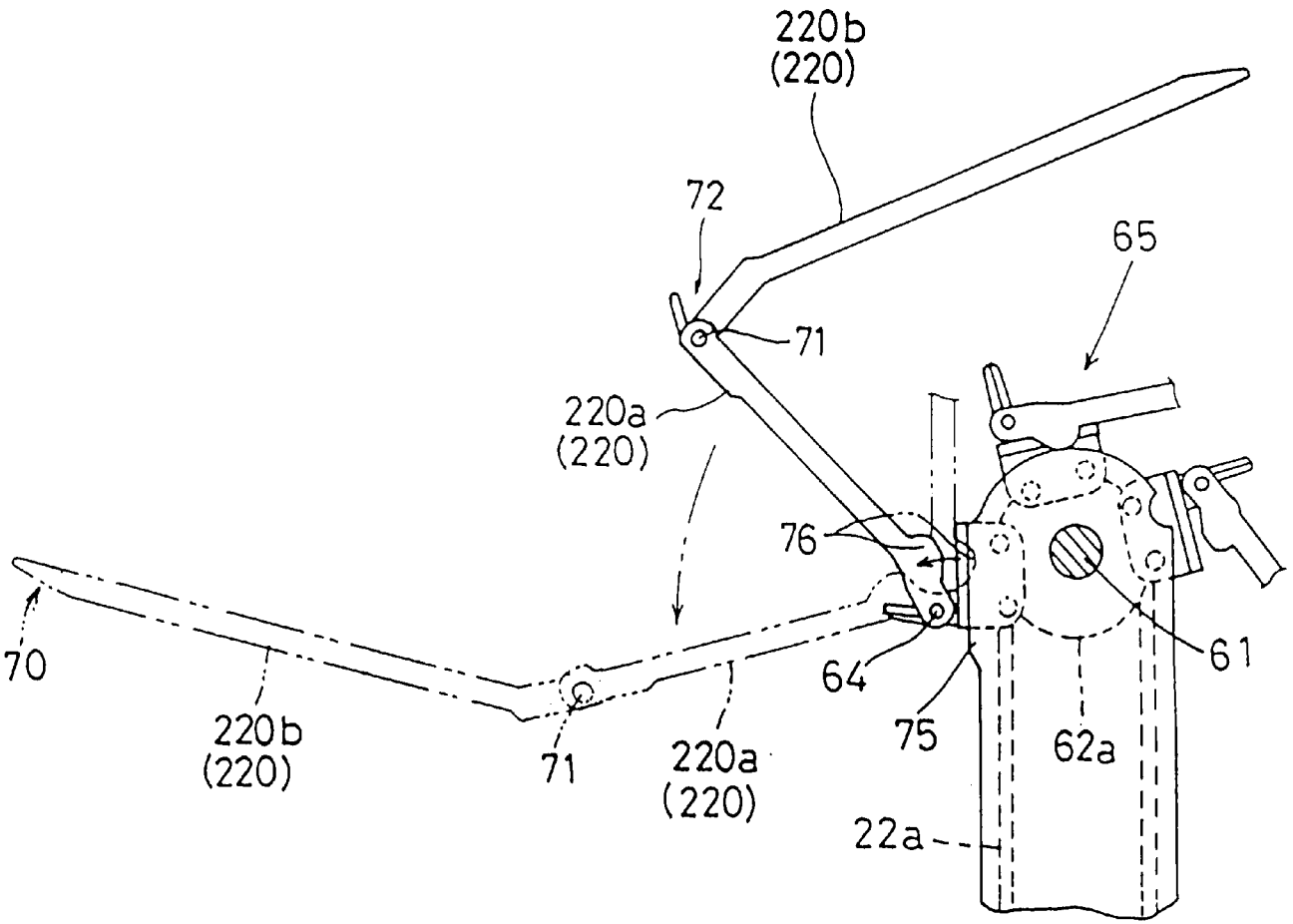
FIG. 12 shows a receiver plate relating to a fifth embodiment.

In the embodiments shown in FIGS. 8 and 10, the receiver plate 22 is folded at the position of the pivot shaft 71. Yet, the present invention is not limited thereto. Instead, as in FIG. 12 showing a fifth embodiment of the present invention, the distal-end receiver element 220*b* per se may be formed bent. Or, the base-end receiver element 220*a* per se may be formed bent.

Further alternatively, the base-end receiver element 220*a* may extend straight while the distal-end receiver element 220*b* may extend with a curve.

Figure 13:
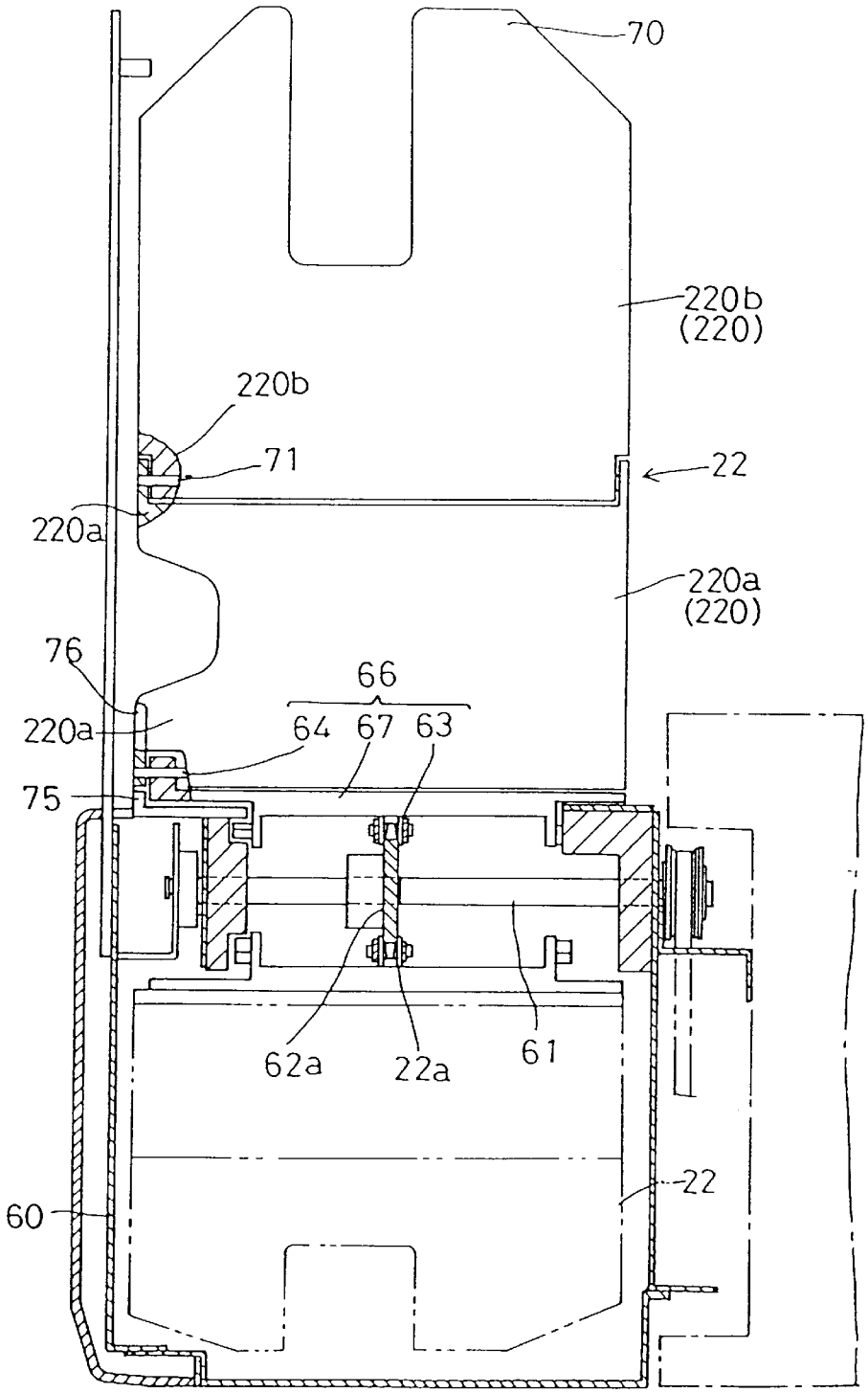
FIG. 13 shows a receiver plate relating to a sixth embodiment.

Next, a sixth embodiment of the invention will be described with reference to FIG. 13.

In order to restrict occurrence of rebound of the receiver plate 22, O-rings are employed in the foregoing embodiment. The rebound may be restricted also by using material having shock-absorbing property.

Namely, the receiver elements 220 constituting the receiver plate 22 may be formed of such material having shock-absorbing property. One example of such material is elastomer, which includes a thermosetting elastomer and thermoplastic elastomer. The former type elastomer specifically includes polyurethane, various rubbers, elastic epoxy resins and the latter type elastomer specifically includes shock-absorbing ABS, SBS, polyurethane.

In forming the plate 22 of the elastomer, the entire receiver plate 22 may be formed of the elastomer. Or, since the undesirable shock occurs when the first contact portion 68 and the first contacted portion 69 and/or the second contact portion 73 and the second contacted portion 74 come into contact with each other, only these portions of the plate 22 may be formed of the elastomer. In this latter case, the receiver elements 220 may be manufactured by the two-step molding method, or the first contact portion 68 and the other portion (also the second contact portion 73, the second contacted portion 74) may be formed separately and then bonded to each other by means of e.g. adhesion.

Further alternatively, only either one of the receiver elements 220*a*, 220*b*, e.g. the base-end receiver element 220*a* alone, may be formed of the elastomer. Or, the receiver-plate support portion 66 alone may be formed of the elastomer. Still alternatively, only the first contacted portion 69 of the receiver-plate support portion 66 may be formed of the elastomer.

Still further embodiments of the present invention will be specifically described next.

[1] In the foregoing embodiments, the receiver plate is comprised of two elements. The number of these elements may vary appropriately. In general, the greater the number, the easier to render short the distance between the chain and the sorter frame.

[2] In the foregoing embodiments, the O-rings are employed as the resistance means. Any other means capable of providing the dumping effect may be employed instead.

[3] In the foregoing embodiments, the first resistance means and the second resistance means are provided. Instead, only one of them may be provided.

[4] Needless to say, if the receiver plate is comprised of single element, only the first resistance means will be provided.

[5] Concerning the attaching construction of the resistance means, in place of providing them between the shaft and the receiver elements, the resistance means may be provided between the receiver element and the sorter frame or any other component provided integrally with the sorter frame. In short, the resistance means may be attached to any position capable of restricting the shock during the posture switchover operation.

[6] In addition of the elastomer, the shock-absorbing material includes also certain metallic material having this property.

[7] In the foregoing embodiments, the receiver plate support shaft and the pivot shaft are provided as separate components. Instead, these may be provided integrally with other components. For instance, the pivot shaft and the receiver element may be formed integral with each other. Hence, these support or pivot shafts should be understood to generically include 'axes'.

The invention may be embodied in other specific forms without departing from the spirit or essential characteristics thereof. The present embodiments are therefore to be considered in all respects as illustrative and not restrictive, the scope of the invention being indicated by the appended claims rather than the foregoing description and all changes which come within the meaning and range of equivalency of the claims are therefore intended to be embraced therein.

What is claimed is:

1. An apparatus comprising:

a plurality of receiver members for receiving a workpiece;

a rotary circulating mechanism which circulates along a circulatory path, the circulating mechanism including a plurality of receiver-plate support shafts for pivotally mounting the receiver members;

whereas, on the circulatory path of the rotary circulating mechanism, said each receiver member is switchable between an extended posture at which the receiver member is capable of receiving the workpiece and a folded posture at which the receiver member is pivotally folded about the receiver-member support shaft to the vicinity of the rotary circulating mechanism;

said each receiver member includes a plurality of receiver elements which are pivotable relative to each other about a pivot shaft extending substantially parallel to the receiver-member support shaft and an extended-posture maintaining mechanism interposed between the adjacent receiver elements for maintaining the receiver elements at a predetermined posture when said receiver member assumes the extended posture; and on the circulatory path of the rotary circulating mechanism, there is provided a posture setting cam for setting the posture of the receiver member, whereas said each receiver member includes a cam contact portion positioned to come into contact with the posture setting cam immediately before a vertical path portion of the circulatory path so as to bring the gravity center of the receiver member to a side opposite to the rotary circulatory mechanism relative to the receiver-member support shaft whereby the receiver member is switched over to said extended posture.

2. An apparatus according to claim 1, wherein the extended-posture maintaining mechanism is capable of maintaining the receiver elements at either a straight posture or a bent posture.

3. An apparatus according to claim 1, further comprising:

resistance means for providing resistance against momentum of the switchover operation of the receiver member between the folded posture and the extended posture.

4. An apparatus according to claim 3, wherein said resistance means comprises an O-ring interposed between said receiver member and a support portion for supporting this receiver member.

5. An apparatus according to claim 3, wherein said resistance means comprises an O-ring interposed between said receiver element and a support portion for supporting the receiver element.

6. An apparatus according to claim 1, wherein the receiver member includes a base-end receiver element disposed adjacent the receiver-member support shaft and a distal-end receiver element pivotable relative to the base-end receiver element about the pivot shaft.

7. An apparatus according to claim 5, wherein the circulatory path of the receiver members includes a vertical path portion, the receiver-member support shaft comprises a horizontal support shaft, and at the extended posture, the receiver member extends obliquely upward relative to the horizontal support shaft.

8. An apparatus according to claim 6, wherein said extended-posture maintaining mechanism includes a contacted portion provided to the base-end receiver element and a contacting portion provided to the distal-end receiver element.

9. An apparatus comprising:

a plurality of receiver members for receiving a workpiece;

a rotary circulating mechanism which circulates along a circulatory path, the circulating mechanism mounting the receiver members to be pivotable about a first pivot axis;

wherein, on the circulatory path of the rotary circulating mechanism, said each receiver member is switchable between an extended posture at which the receiver member is capable of receiving the workpiece and a folded posture at which the receiver member is pivotally folded about the first axis to the vicinity of the rotary circulating mechanism;

said each receiver member has at least one second pivot axis extending substantially parallel to the first pivot axis;

said each receiver member includes a plurality of receiver elements which are pivotable relative to each other about said second pivot axis and an extended-posture maintaining mechanism interposed between the adjacent receiver elements for maintaining the receiver elements at a predetermined posture when said receiver assumes the extended posture; and on the circulatory path of the rotary circulating mechanism, there is provided a posture setting cam for setting the posture of the receiver member, whereas said each receiver member includes a cam contact portion positioned to come into contact with the posture setting cam immediately before a vertical path portion of the circulatory path so as to bring the gravity center of the receiver member to a side opposite to the rotary circulating mechanism relative to the first pivot axis whereby the receiver member is switched over to said extended posture.

10. An apparatus according to claim 1, wherein the receiver member includes a base-end receiver element disposed adjacent the first pivot axis and a distal-end receiver element pivotable relative to the base-end receiver element about the second pivot axis.

11. An apparatus according to claim 10, wherein the circulatory path of the receiver members includes a vertical path portion, the first pivot axis comprises a horizontal axis, and at the extended posture, the receiver member extends obliquely upward relative to the horizontal first pivot axis.

12. An apparatus comprising:

a plurality of receiver members for receiving a workpiece;

a rotary circulating mechanism which circulates along a circulatory path, the circulating mechanism including a plurality of receiver-plate support shafts for pivotally mounting the receiver members;

whereas, on the circulatory path of the rotary circulating mechanism, said each receiver member is switchable between an extended posture at which the receiver member is capable of receiving the workpiece and a folded posture at which the receiver member is pivotally folded about the receiver-member support shaft to the vicinity of the rotary circulating mechanism;

said each receiver member includes a plurality of receiver elements which are pivotable relative to each other about a pivot shaft extending substantially parallel to the receiver-member support shaft and an extended-posture maintaining mechanism interposed between the adjacent receiver elements for maintaining the receiver elements at a predetermined posture when said receiver member assumes the extended posture; and resistance means for providing resistance against momentum of the switchover operation of the receiver member between the folded posture and the extended posture;

wherein said resistance means comprises an O-ring interposed between said receiver member and a support portion for supporting this receiver member.

13. An apparatus comprising:

a plurality of receiver members for receiving a workpiece;

a rotary circulating mechanism which circulated along a circulatory path, the circulating mechanism including a plurality of receiver-plate support shafts for pivotally mounting the receiver members;

whereas, on the circulatory path of the rotary circulating mechanism, said each receiver member is switchable between an extended posture at which the receiver member is capable of receiving the workpiece and a folded posture at which the receiver member is pivotally folded about the receiver-member support shaft to the vicinity of the rotary circulating mechanism;

said each receiver member includes a plurality of receiver elements which are pivotable relative to each other about a pivot shaft extending substantially parallel to the receiver-member support shaft and an extended-posture maintaining mechanism interposed between the adjacent receiver elements for maintaining the receiver elements at a predetermined posture when said receiver member assumes the extended posture; and resistance means for providing resistance against momentum of the switchover operation of the receiver member between the folded posture and the extended posture;

wherein said resistance means comprises an O-ring interposed between said receiver element and a support portion for supporting the receiver element.

* * * * *